US005287624A

United States Patent [19]

Mondo et al.

[11] Patent Number: 5,287,624

[45] Date of Patent: Feb. 22, 1994

[54] VERY EASY

[76] Inventors: Luciano G. Mondo, 450 Little Pl. #51, No. Plainfield, N.J. 07060; George Spector, 233 Broadway Rm 702, New York, N.Y. 10279

[21] Appl. No.: 13

[22] Filed: Jan. 4, 1993

[51] Int. Cl.[5] ..... B26B 19/44; B26B 21/08

[52] U.S. Cl. ..... 30/41; 30/50

[58] Field of Search ..... 30/48, 49, 50, 41, 47; 48/43

[56] References Cited

U.S. PATENT DOCUMENTS

| | | | |
|---|---|---|---|
| 3,417,468 | 12/1968 | Miyauchi | 30/41 |
| 3,703,765 | 11/1972 | Perez | 30/41 |
| 4,129,942 | 12/1978 | Denizman | 30/41 |
| 4,501,066 | 2/1985 | Sceberras | 30/50 |
| 4,635,361 | 1/1987 | DeMars | 30/41 |
| 4,696,106 | 9/1987 | Cross et al. | 30/41 |
| 4,791,723 | 12/1988 | Jacobson | 30/41 |
| 4,809,432 | 3/1989 | Schauble | 30/41 |
| 4,813,138 | 3/1989 | Chen | 30/41 |

*Primary Examiner*—Richard K. Seidel
*Assistant Examiner*—Paul M. Heyrana, Sr.

[57] ABSTRACT

An improved disposable safety razor is provided which consists of an elongated handle with a head having a convex top surface and a flat bottom surface attached to an upper end of the elongated handle. A pair of single cutting edge razor blades are clamped parallel within the head with the cutting edges angled outwardly and upwardly in opposite direction from the convex top surface of the head, so as to be useful in shaving in both forward and rearward strokes.

3 Claims, 1 Drawing Sheet

VERY EASY

BACKGROUND OF THE INVENTION

The instant invention relates generally to razors and more specifically it relates to an improved disposable safety razor, which provides two angularly positioned single edge razor blades for shaving in forward and rearward strokes.

There are available various conventional razors which do not provide the novel improvements of the invention herein disclosed.

SUMMARY OF THE INVENTION

A primary object of the present invention is to provide an improved disposable safety razor that will overcome the shortcomings of the prior art devices.

Another object is to provide an improved disposable safety razor, in which the head contains a pair of angularly positioned single cutting edge razor blades useful in shaving in both forward and rearward strokes.

An additional object is to provide an improved disposable safety razor, in which contained within the handle is a supply of pressurized shaving cream and a mechanism for releasing the shaving cream therefrom.

A further object is to provide an improved disposable safety razor that is simple and easy to use.

A still further object is to provide an improved disposable safety razor that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 2:
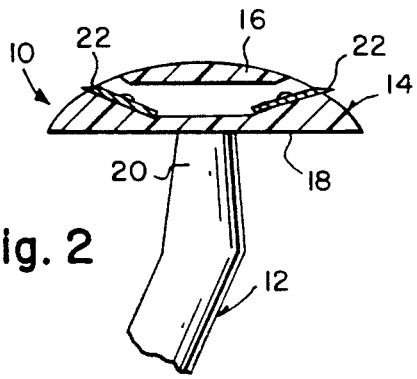
FIG. 2 is a cross sectional view taken along line 2—2 in FIG. 1.
Figure 1:
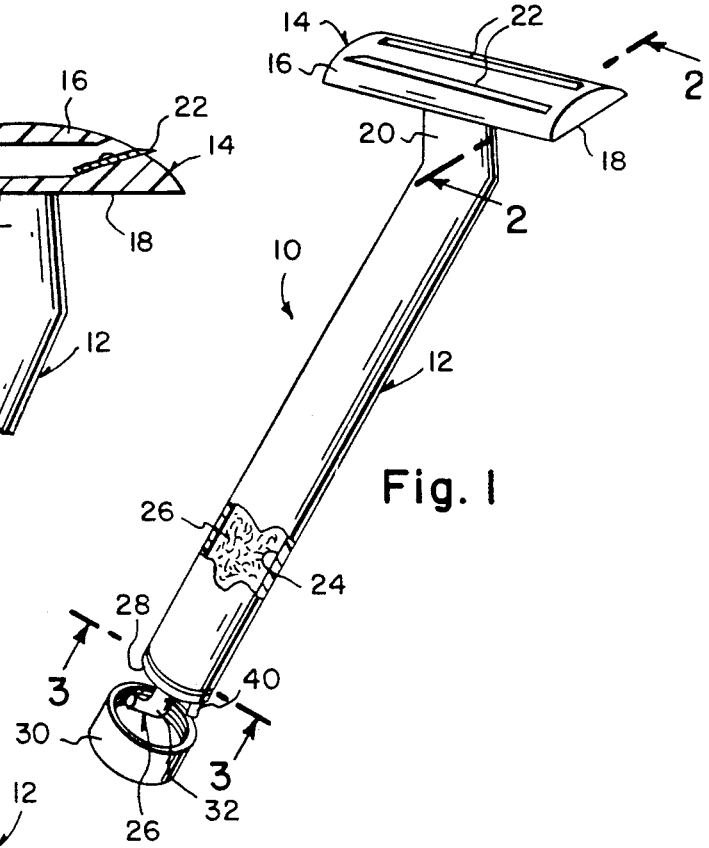
FIG. 1 is a front perspective view of the instant invention.

Turning now descriptively to the drawings, in which similar reference characters denote similar elements throughout the several views, the Figures illustrate an improved disposable safety razor 10 which consists of an elongated handle 12, with a head having a convex top surface 16 and a flat bottom surface 18, attached to an upper end 20 of the elongated handle 12. A pair of single cutting edge razor blades 22 are clamped parallel within the head 12 with the cutting edges angled outwardly and upwardly in opposite directions from the convex top surface 16 of the head 14, so as to be useful in shaving in both forward and rearward strokes.

The elongated handle 12 has a chamber 24 therein to hold pressurized shaving cream 26. A mechanism 26 is at a lower end 28 of the elongated handle 12 for releasing the shaving cream 26 from within the chamber 24. A safety cap 30 is threaded to the lower end 28 of the elongated handle 12 for covering the shaving cream releasing mechanism 26.

Figure 3:
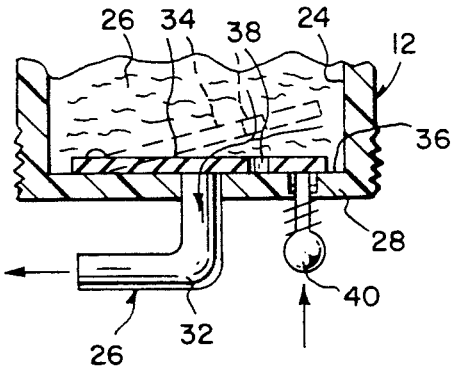
FIG. 3 is an enlarged cross sectional view taken along line 3—3 in FIG. 1, showing the shaving cream release mechanism in greater detail.

The shaving cream releasing mechanism 26, as best seen in FIG. 3, includes a nozzle 32 having a fluid connection at the lower end 28 of the elongated handle 12, in which the nozzle 32 is bent at a right angle thereto. A flap valve 34 is secured to an inner surface 36 of the lower end 28 of the elongated handle 12 to cover the fluid connection of the nozzle 32. The flap valve 34 has an aperture 38 therethrough, not in alignment with the fluid connection of the nozzle 32. A spring biased push button 40 is located at the lower end 28 of the elongated handle 12, to engage with the flap valve 34. When the push button 40 is depressed it will open the flap valve 34 to allow the shaving cream 26 to pass through the aperture 38 and the open flap valve 34 to enter the nozzle 32 and exit therefrom.

Figure 4:
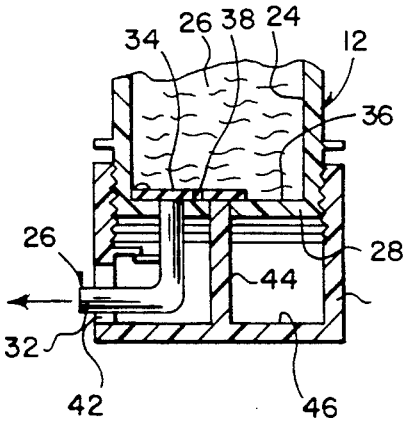
FIG. 4 is a cross sectional view showing a modification of the shaving cream release mechanism, in which the rotation of the safety cap will operate the mechanism therein.

The shaving cream releasing mechanism 26, as shown in FIG. 4, contains a nozzle 32 having a fluid connection at the lower end 28 of the elongated handle 12, in which the nozzle 32 is bent at a right angle thereto. A flap valve 34 is secured to an inner surface 36 of the lower end 28 of the elongated handle 12 to cover the fluid connection of the nozzle. The flap valve 34 has a aperture 38 therethrough, not in alignment with the fluid connection of the nozzle 32. The safety cap 30 has a slot 42 in its side wall, so that a distal end of said nozzle 32 can extend therethrough. A center rod 44 extends upwardly from an inner surface 46 of the safety cap 30 to extend through the lower end 28 of the elongated handle 12, to engage with the flap valve 34. When the safety cap 30 is turned the center rod 44 will open the flap valve 44 to allow the shaving cream 26 to pass through the aperture 38 and the open flap valve 34 to enter the nozzle 32 and exit therefrom.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A disposable safety razor which comprises:

a) an elongated handle;

b) a head with an external cavity having symmetrical spaced openings in a convex top surface attached to an upper end of said elongated handle; and c) a symmetrical pair of single razor blades mounted in said head within said openings with said blades angled to extend outwardly and upwardly in opposite directions from said openings in the convex top surface of said head, for shaving in both forward and rearward strokes.

2. A disposable safety razor as recited in claim 1, further including:

a) said elongated handle having a chamber therein to hold pressurized shaving cream;

b) means at a lower end of said elongated handle for releasing the shaving cream from within the chamber; and c) a safety cap threaded to the lower end of said elongated handle for covering said shaving cream releasing means; wherein said shaving cream releasing means includes:

d) an outlet nozzle having a fluid connection to said chamber at the lower end of said elongated handle, said nozzle bent at a right angle thereto;

e) a flap valve in said chamber secured to an inner surface of the lower end of said elongated handle to seal the fluid connection of said nozzle, said flap valve having an aperture therethrough not in alignment with the fluid connection of said nozzle; and f) a spring biased push button located at the lower end of said elongated handle to engage with said flap valve, so that when said push button is pushed inward it will open said flap valve to allow the shaving cream to pass through the aperture and said open valve to enter said nozzle and exit therefrom.

3. A disposable safety razor as recited in claim 1, further including a shaving cream chamber in said handle with means for dispensing the shaving cream comprising:

a) a cap adjustable mounted on said lower end with an outlet nozzle extending outwardly through an outlet port from said chamber;

b) a flap valve in said chamber normally sealing said outlet port; said flap valve having an aperture therethrough not in alignment with said port;

c) said cap having a slot through which said nozzle extends therethrough; and d) a rod extending inwardly from said cap through said lower end of said elongated handle to engage with said flap valve, so that when said safety cap is adjusted said rod will open said flap valve to allow the shaving creams to pass through said aperture and said open flap valve to enter said nozzle and exit therefrom.

* * * * *